US005240174A

United States Patent [19]

Wenninger

[11] Patent Number: 5,240,174

[45] Date of Patent: Aug. 31, 1993

[54] ENVIRONMENTALLY FRIENDLY AND SPACE EFFICIENT BATTERY PACKAGE

[75] Inventor: Terrance L. Wenninger, Crestline, Ohio

[73] Assignee: Eveready Battery Company, Inc., St. Louis, Mo.

[21] Appl. No.: 936,487

[22] Filed: Aug. 28, 1992

[51] Int. Cl.[5] ..... B65D 5/46; B65D 5/48

[52] U.S. Cl. ..... 229/117.15; 229/120.03; 229/120.18

[58] Field of Search ..... 229/117.14, 117.15, 229/117.22, 120.11, 120.18, 120.03, 120.04; 206/806

[56] References Cited

U.S. PATENT DOCUMENTS

| | | | |
|---|---|---|---|
| 1,737,950 | 12/1929 | Scotland | 229/120.18 |
| 1,898,231 | 2/1933 | Weiss | 229/120.18 |
| 2,097,941 | 11/1937 | Wells et al. | 229/120.18 |
| 2,684,178 | 7/1954 | Keeler | 229/120.18 |
| 2,747,785 | 5/1956 | Fink | 229/120.03 |
| 2,748,978 | 6/1956 | Hennessey et al. | 229/120.03 |
| 2,881,946 | 4/1959 | Bosrock et al. | 229/120.18 |
| 3,033,356 | 5/1962 | Meyerson | 229/117.14 |
| 3,199,762 | 8/1965 | Coons | 229/120.18 |
| 3,404,806 | 10/1968 | Richardson | 229/117.15 |
| 4,308,986 | 1/1982 | Parrilli | 206/806 |
| 4,651,918 | 3/1987 | Moore et al. | 229/120.18 |
| 5,065,937 | 11/1991 | Ritter | 229/120.18 |
| 5,088,641 | 2/1992 | Shepard | 229/120.18 |

FOREIGN PATENT DOCUMENTS

| | | | |
|---|---|---|---|
| 2086850 | 5/1982 | United Kingdom | 229/120.18 |

*Primary Examiner*—Gary E. Elkins
*Attorney, Agent, or Firm*—Robert W. Welsh

[57] ABSTRACT

A blank box production die and a box made therefrom including a front panel and a back panel hingedly attached to each other by side panels along score lines. A divider panel is provided, integrally dependent and extending from one of the panels to an interior of the box. The divider panel interconnects two side panels, providing a first and second interior volume. The bottom of the box is sealed by closure flaps dependent from a lower edge of the front, back and side panels. The top of the box is sealed by closure flaps disposed on each side of the divider/header panel. The top closure flaps are integral with and dependent from an upper edge of the front, back and side panels, and are adapted to fold into and close volume defined by the divider/header panel.

26 Claims, 6 Drawing Sheets

ENVIRONMENTALLY FRIENDLY AND SPACE EFFICIENT BATTERY PACKAGE

FIELD OF THE INVENTION

This invention relates to a paperboard container and, more particularly, to a paperboard box constructed from a single, uninterrupted paperboard production die blank.

BACKGROUND OF THE INVENTION

Many package designs for batteries have used either a combination of plastic and paper or just plastic, to create an informative and attractive package. Thermally formed polyvinyl chloride is just one of the plastics that has been used to form a package for the sale of batteries. This material has often been combined with a paper coupon or label to advertise the product. Unfortunately, the mixture of paper and plastic is difficult to separate and, therefore, recycling of the package is not economically feasible. Many of these packages also have the disadvantage of forcing the customer to remove all the batteries once the package is opened. The package must be discarded even though the customer may only need one of the batteries at the time that the package is opened and would like to store the remaining new batteries until they are needed. Furthermore, very few of the prior art packages are designed to store battery cells that have been used by the consumer. Even the temporary storage of dead cells is useful because the consumer can reliably and conveniently separate the new cells from the dead cells during the battery changing process. Moreover, another problem with prior known packages is that they were not intended to return used batteries to the manufacturer or other party so that the batteries could be recycled. Most, if not all, of the prior known packages are intended to retain the product from the manufacturer or supplier to the customer. That is to say that the package is "one-way" and is destroyed or discarded when the customer ultimately uses the product or opens the package.

SUMMARY OF THE INVENTION

The desire to manufacture products that are environmentally friendly has prompted the instant invention which requires a minimum amount of packaging material and is made from a single integrally connected sheet of material that can be readily recycled. The instant invention provides a box that is well suited for carrying a plurality of cylindrical products. The inventive package minimizes the required amount of packaging material while maximizing the number of cylinders that can be stored and displayed within a fixed volume. After the box has been opened, the products can be stored until they are needed and used products can be inserted into the box after the new ones have been removed. Preferably, the box is made from recycled paper that has been printed with water-based ink so that the box may be recycled. The inventive package is of such rigid construction so as to retain the product when returned by the customer or end user to the manufacturer or other party recycling the product or its contents. That is to say that the inventive package is designed to be "two-way" between the end user, manufacturer or third party.

The instant invention includes a blank, and a package made therefrom, having novel features which are combined to form a handy and reusable container for storing products such as batteries. The blank and the box are made from a single sheet of material and have integrally interconnected panels which, when folded and/or glued, minimize the required amount of packaging material while maximizing the number of products that can be stored and displayed within the fixed volume.

In one embodiment, the box includes an upstanding header/divider panel centrally located along one of the box top centerlines. A plurality of flaps are used to seal the top and bottom of the box. The four side panels of the box, centrally located interior divider/header, and flaps are made as a single piece.

In another embodiment, the box can be characterized as a cube including an upstanding header/divider panel centrally located along one of the box top centerlines. Four fold-in flaps and two fold-over tuck-in flaps are used to seal the top of the box. The bottom of the box is sealed by two fold-in flaps and two fold-over/tuck-in flaps that overlap each other. The four side panels of the box, centrally located interior divider/header, fold-in flaps and tuck-in flaps are made as one piece.

In another embodiment of the invention, the container includes a box having an upstanding header/divider panel dividing the volume of the box. The box includes a front panel and a back panel hinged to side panels and having a top and bottom opening. The bottom opening is closed by flaps dependent from the lower edge of the front, back and side panels, and adapted to be folded into the box and glued or otherwise sealed together The header/divider panel is dependent from one of the panels to an interior of the box and fixed to one of the other remaining panels, defining a first and second volume within the box. A portion of the divider panel extends from the top opening. The top opening includes flaps dependent from an edge of the opening and adapted to fold in and seal the first and second volume within the box.

Another embodiment of the box can be characterized as a front panel and a back panel hingedly attached by said side panels along vertical fold lines, and having a top and bottom opening. The front, back and side panels form a rectangular or cubical volume. A divider/header panel, dependent from one of the panels and disposed to the interior of the box, has one end fixed to an opposite panel, dividing the interior of the rectangular volume into a first and second chambers. The divider includes a portion which extends above the top of the box. The bottom of the box is sealed by closure flaps dependent from a lower edge of the front, back and side panels, each adapted to fold in toward and close the bottom of the box. The top of the box is sealed by top closure flaps dependent from an upper edge of the front, back and side panels, each adapted to fold in and close the top of the first and second chambers defined by the divider/-header panel extending above the closed top.

One embodiment of the blank can be characterized as a single sheet of material having a plurality of panels defined thereon, including a front panel, a rear panel and a first and second side panel, hingedly attached to each other by a plurality of transverse score lines and each having a top and bottom edge defined by longitudinal score lines. An upper and a lower fold-in flap are defined along, and integrally dependent from, the top and bottom edge of the first and second side panel. An upper and a lower tuck-in flap are defined along, and integrally dependent from, the top and bottom edge of the front and back panel. A divider/header panel is integrally extending from one end of the plurality of panels along a line parallel to the transverse score lines, and having a bottom edge coterminous with the bottom edge of the panels. An upper edge of the divider/header panel extends beyond the upper edge of the back, front and side panels.

In another embodiment of the blank, the front, back and side panels are arranged linearly with the side panels alternating with the front and back panels. The divider/header panel includes an integral locater tab interconnecting the divider/header panel to one of the plurality of panels and a glue tab extending from an edge opposite the locater tab to fix the opposite edge of the divider/header. The top of the divider/header panel further includes a header panel hingedly connected thereto along a slit-score line parallel to the longitudinal lines. A score line parallel to the top of the box allows the divider/header to fold flat for easy shipping and stacking.

The advantages provided by this invention include a reusable container particularly adapted for storing batteries. The blank, and the box made therefrom, require a minimum amount of packaging material. The blank and box are made from a single sheet of material wherein the panels are integrally interconnected to each other. No parts separate and independent from the blank need be stamped. In forming the box, the integral divider/header of the blank is securely attached to the side panels of the box. This construction substantially eliminates distortion, breakage or tearing of the box when the package is suspended from a rod which extends through an opening in the header/divider. Another important advantage realized by this invention is that the divider/header panel and the manner in which it is connected to the side panels virtually insures that the box will be square when it is manufactured and that it will remain square and rigid when used by the consumer. Furthermore, by centrally locating the divider/-header within the box, forming the substantially equal volume smaller chambers, the box may be hung without tipping either forward or backward, or leaning to either side.

An additional feature of the box is the incorporation of a hinge where the header/divider protrudes through the top of the box. The ability to fold the header flat against the top of the box provides for maximum density when packed in boxes for shipment, or arranging them for display on the store shelf. Extension of the header in a vertical direction allows the box to be hung in a conventional display rack while maximizing the box's surface area that is available for advertising.

These and other features, objects and advantages of the present invention will become apparent upon reading the following description thereof together with reference to the accompanying drawings.

DETAILED DESCRIPTION OF THE PREFERRED EMBODIMENTS

Definitions

Figures 1, 2, 3:
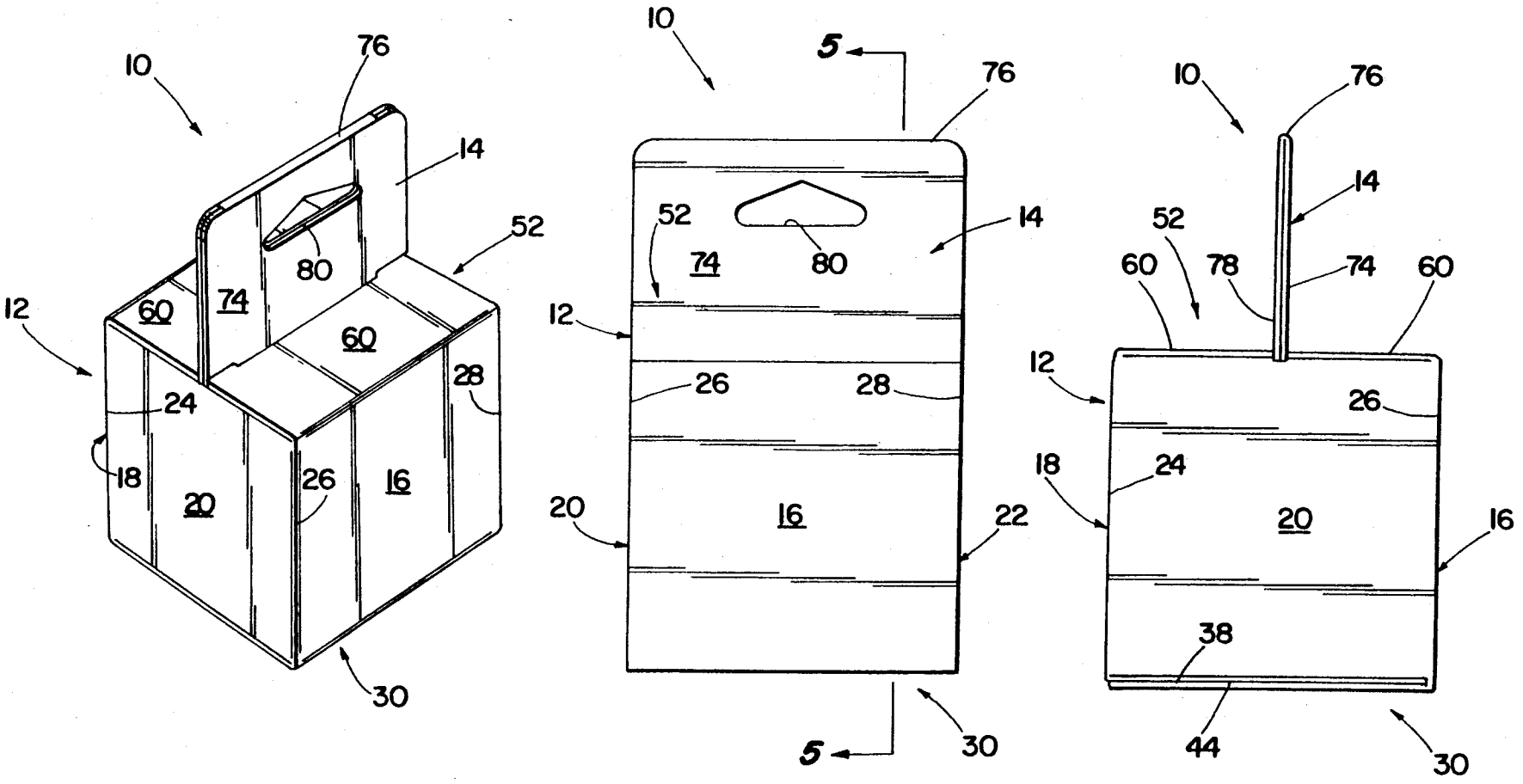
FIG. 1 is an oblique view of a rectangular box.
FIG. 2 is a front view of the rectangular box.
FIG. 3 is a side view of the rectangular box.

"Package" shall refer to a box or container having closed end faces and completely enclosing the contents.

"Paperboard" shall include a broad classification of materials made of cellulosic fibers on board machines encompassing, fiberboard, liner board, corrugated medium and the plies of solid fiberboard most commonly made from wood pulp or paper stock.

"Flaps" shall refer to closing members of a paperboard box.

"Joints" shall refer to that part of the box where the ends of the scored and slotted blanks are joined together by taping, stitching or gluing.

"Panel" shall refer to a "face" or "side" of a box.

"Score" shall mean an impression or crease in paperboard to locate and facilitate folding.

"Slit" shall refer to a cut made in a paperboard sheet without removal of material.

"Slit-score" shall refer to a cut made in a paperboard sheet extending through only a portion of the thickness.

"Slot" shall refer to a cut made in a paperboard sheet usually to form flaps and thus permit folding.

Referring now to the drawing figures in general, and in particular to FIGS. 1–6, there is shown Applicant's package 10. Package 10 comprises a generally one-piece body 12 with an integral divider 14 constructed from a single paperboard production die blank, described below. The paperboard material used in forming package 10 may include a clay coating on the outside surface of body 12 to facilitate receipt of printed material. The inside surface of body 12 may be coated with generally water impervious material to prevent the ingress of moisture through the paperboard material.

Body 12 includes a front panel 16 and a back panel 18 interconnected by side panels 20 and 22 along vertical fold or score lines 24–28. Bottom 30 of body 12 is closed by fold-in flaps 32 and 34, dependent from side panels 20 and 22, respectively, along horizontal score lines 36. Bottom tuck-in flap 38, having a tab 40, folds over fold-in flaps 32 and 34 along score line 36, and is integrally dependent from back panel 18. Tab 40 is folded along tab score line 42 so as to lie parallel to side panel 22 when in the closed position A second tuck-in flap 44 is folded along score line 36 at the bottom of side panel 22 to close bottom 30. Tab 46, dependent from flap 44, and formed along tab score line 48, is received in slot 50 perforating horizontal score line 36 between back panel 18 and tuck-in flap 38.

Although bottom 30 is preferred to be closed by fold-in and tuck-in flaps 32, 34 and 38, 44 described above, bottom 30 may, in the alternative, be closed by an adhesive between flap 38 and flap 44. If an adhesive is used to join flaps 38 and 44 together, tabs 40 and 46 used to lock flap 38 and 44 together need not be used.

Top 52 of body 12 is closed by two sets of fold-in flaps 54 which fold into the container along horizontal score line 56. Fold-in flaps 54 depend from an upper edge of each side panel 20 and 22 and include a cutout 58 along a centerline so as to accommodate integral divider/header 14. Tuck-in flaps 60 at the top of front and back panels 16 and 18, respectively, fold inwardly along score line 56 to cover fold-in flaps 54. Tabs 62, formed by score lines 64 at the ends of each tuck-in flap 60, lie adjacent integral divider/header 14 and retain flaps 60 in the closed position.

Figure 5:
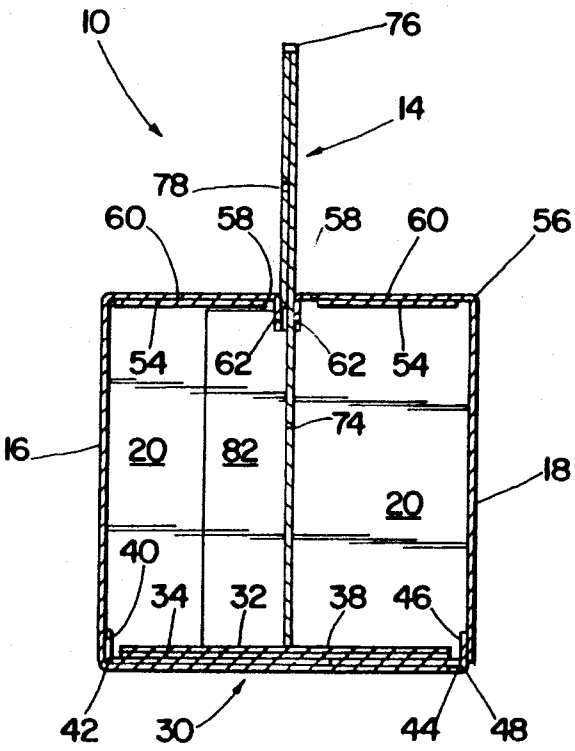
FIG. 5 is a side sectional view taken along line V—V of FIG. 2.
Figure 4:
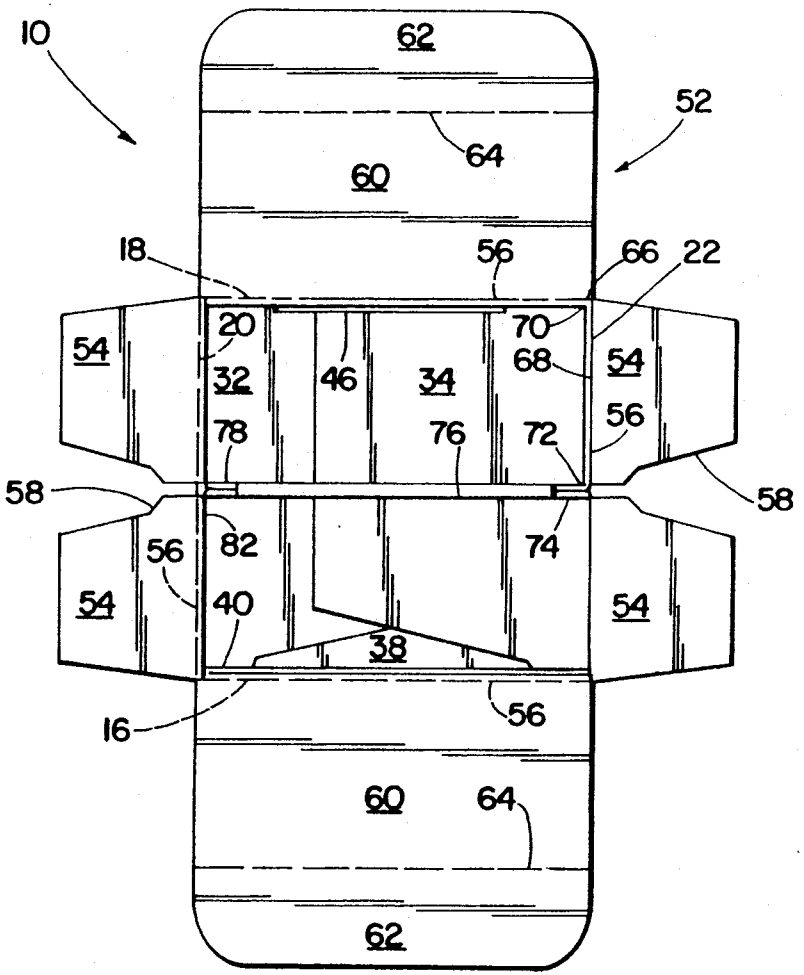
FIG. 4 is a top plan view of the rectangular box with the top open.
Figure 6:
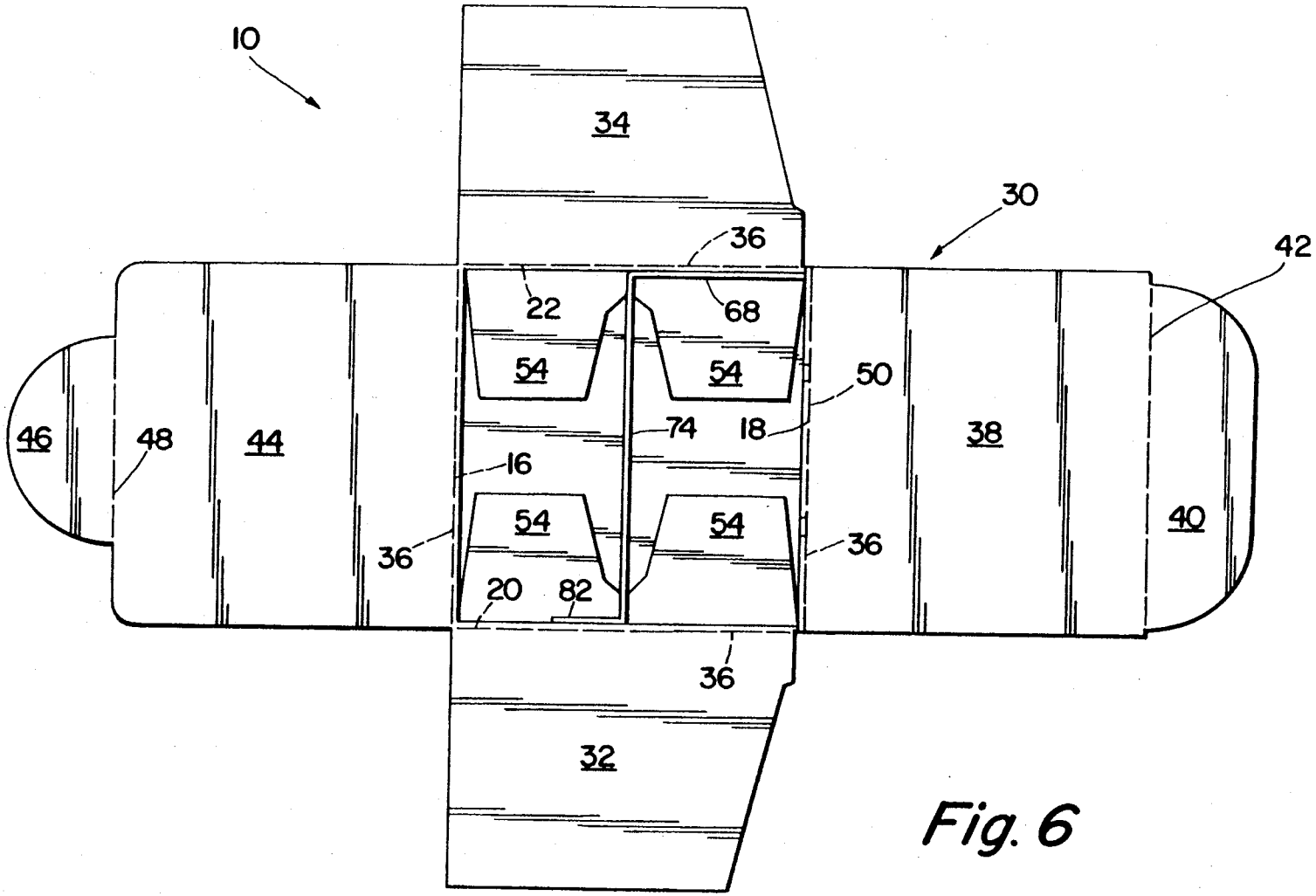
FIG. 6 is a bottom plan view of the rectangular box with the bottom open.

In FIGS. 4 and 5, vertical edge 66 of panel 18, immediately adjacent panel 22, includes an integral locater tab or panel 68 coupled at score line 70. Locator tab 68 is interior of and immediately adjacent side panel 22 fixed thereto by an adhesive commonly used in paperboard box construction. Locater tab 68 extends from score line 70 with back panel 18 to approximately the midpoint or centerline of side panel 22, where it is joined at score line 72 to divider/header 14.

Divider/header 14 includes a divider panel 74 which extends substantially from the bottom 30 of body 12 to slit-score line 76. Divider panel 74 is folded back upon itself at slit-score line 76 to form header panel 78 terminating just below upper score line 56. Below slit-score line 76, and extending through panels 74 and 78, is a punch-out 80 of predetermined shape for the purposes of suspending package 10 from a hanger.

An edge of divider panel 74 opposite locater panel 56 has glue tab 82 extending therefrom, which is adhered to an inner surface of side panel 20 by the adhesive to be used to adhere locater tab 68 to the inner surface of side panel 22. Bonding of tabs 68 and 82 to side panels 20 and 22 not only locate divider 14, but also bond the sides of container 10 together to form a stronger package. The bonding surfaces of tabs 68 and 82 may contain shallow perforations in order to absorb some of the adhesive and improve the bond between the panels.

Locater tab 68, extending from score line 70 to score line 72, establishes the distance for one end of divider panel 74. The edge of divider panel 74, opposite locater tab 68, is preferably located directly opposite the attachment point on side panel 22. It is preferred that divider panel 74 be located along a centerline of side panels 20 and 22 with glue tab 82 attached to side panel 20 on a side of divider panel 74 opposite that of locater tab 68. However, glue tab 82 may be folded in an opposite direction so as to be fixed to side panel 20 on the same side of the divider panel as locater tab 68. The purpose of adhering glue tab 82 to side panel 22 on a side of divider panel 74 opposite locater tab 68 is for ease of construction.

Figure 7:
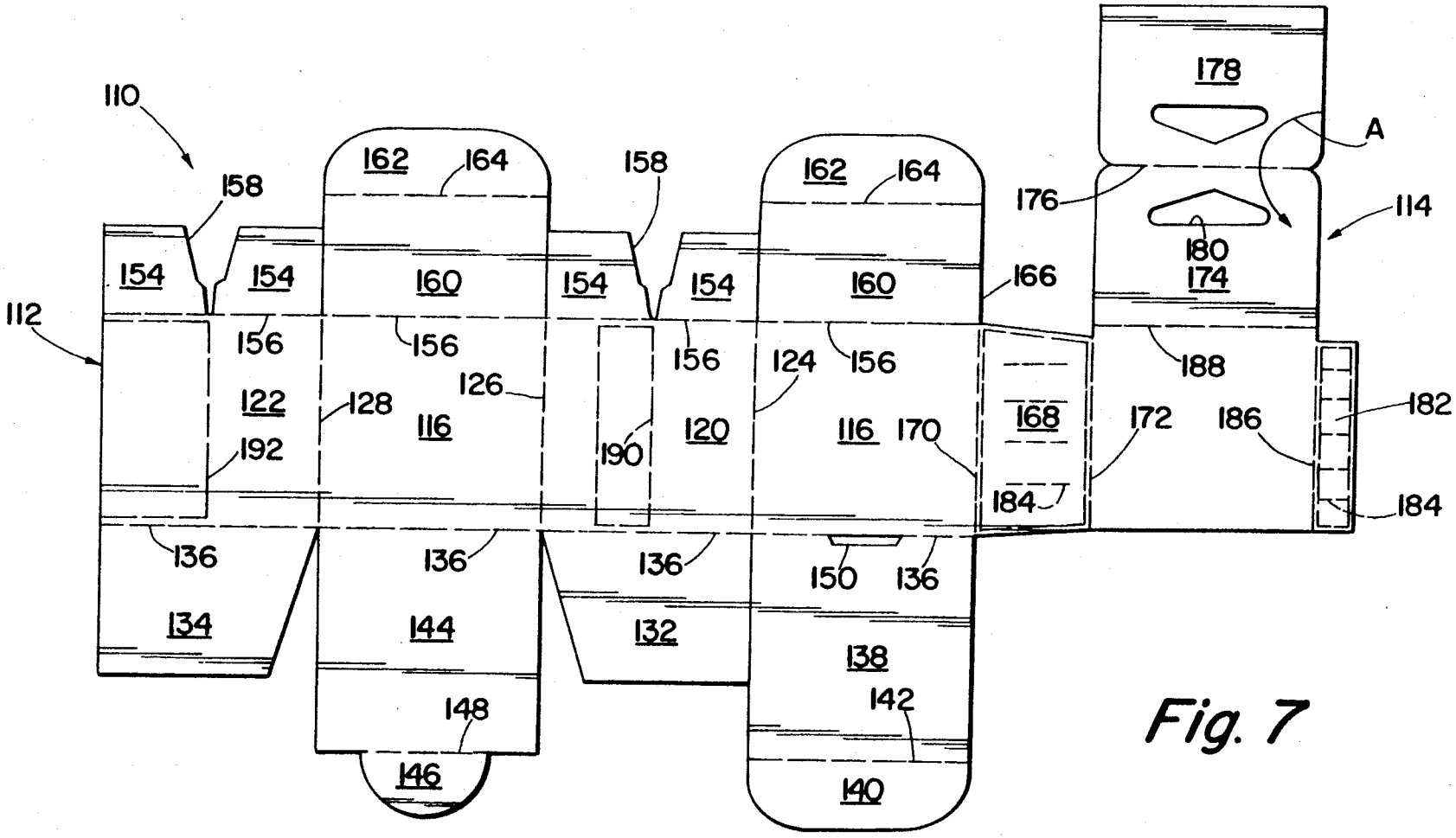
FIG. 7 is a plan view of a production blank die used to form the rectangular box in accordance with this invention.
Figure 8:
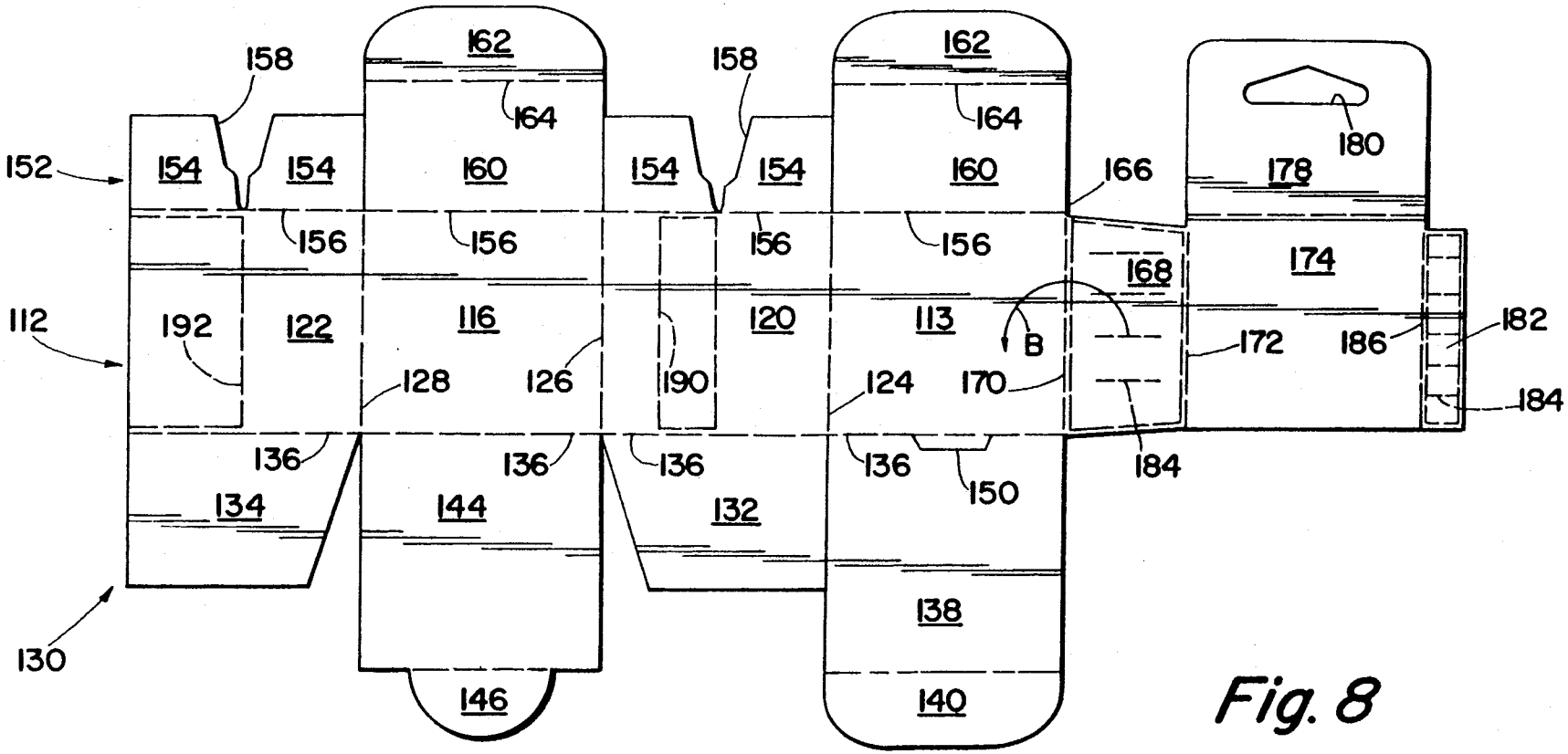
FIGS. 8–10 are plan views of the production blank at different stages of folding.

Reference is made now to FIG. 7 which shows a production blank, shown generally by the numeral 110, used to make package 10. Production blank 110 is preferably made from a single sheet of paperboard stock in a continuous process on a die press. The sheet material, preferably from a continuous roll, is fed into one end of a die press where one or more male die blades and rules cut out the production blank 110, score the fold lines and slit the material to form the various flaps and panels.

Production blank 110 includes a front panel 116 and back panel 118 which are hingedly attached to side panels 120 and 122 along score lines 124, 126 and 128. The upper and lower edges of each panel 116–122 are defined by parallel horizontal score lines 136 and 156 which also form the hinge lines for the lower and upper closure flaps. Bottom fold-in flaps 132 and 134 are hingedly attached along score line 136 to side panels 122 and 120, respectively. Similarly, bottom tuck-in flaps 138 and 144 are hingedly attached along score line 136 to back and front panels 118 and 116, respectively. Tuck-in flap 140 is hingedly attached to flap 138 along score line 142 similar to tab 146 hingedly attached along score line 148 to flap 144. A slit 150 is formed in score line 136 between back panel 118 and flap 138 to receive tab 146. If it is desired to close bottom 30 by gluing flaps 138 and 144, tabs 140 and 146 may be dispensed with, as well as slit 150. Moreover, the length of flaps 138 and 144 may be reduced to conserve material. A sufficient amount of material should remain so that the adhesive may be applied to bond the flaps together.

The top flaps of blank 110 include fold-in flaps 154 hinged along score line 156 to the upper edges of side panels 120 and 122. Two fold-in flaps 154 are formed along the upper edge of each side panel 120 and 122 by cutout 158. Similarly, the upper edges of front and back panels 116 and 118 have tuck-in flaps 160 attached thereto along score line 156. Tuck-in tabs 162 are, in turn, hinged to flaps 160 along score line 164 which is parallel to hinge line 156.

Integrally extending from vertical edge 166 of back panel 118 is locater tab 168 hinged along score line 170. Tab 168 tapers from hinge line 170 to another hinge line 172 attaching divider panel 174. At the top of panel 174 is header panel 178 attached by slit-score line 176. This enables header panel 178 to be folded back upon divider panel 174. Defined on an edge of divider panel 174 opposite that of locater tab 168 is a glue tab 182 attached by fold line 186.

Referring to FIGS. 7–10, package 10 is formed from blank 110 by folding header panel 178 along slit-score line 176 onto divider panel 174 shown by arrow A. An adhesive is used to bond header panel 178 against divider panel 174. Divider panel 174, locater tab 168 and glue tab 182 are folded over onto an interior surface of back and side panels 118 and 120, respectively (FIG. 7). By folding along fold line 170 (arrow B in FIG. 8), glue tab 182 is located on the inner surface of side panel 120 as indicated by area 190. Prior to folding, an adhesive is applied either to glue tab 182 or to area 190. In a second step (FIG. 9), front panel 116 and side panel 122 are folded along fold line 126 (arrow C) onto the opposite side of divider panel 174, locater panel 168 and glue tab 182, which overlie rear and side panels 118 and 120, respectively. Prior to folding, an adhesive is applied to the exposed surface of locater tab 168 or to an inside surface of side panel 122, as indicated by dashed areas 192.

Figure 10:
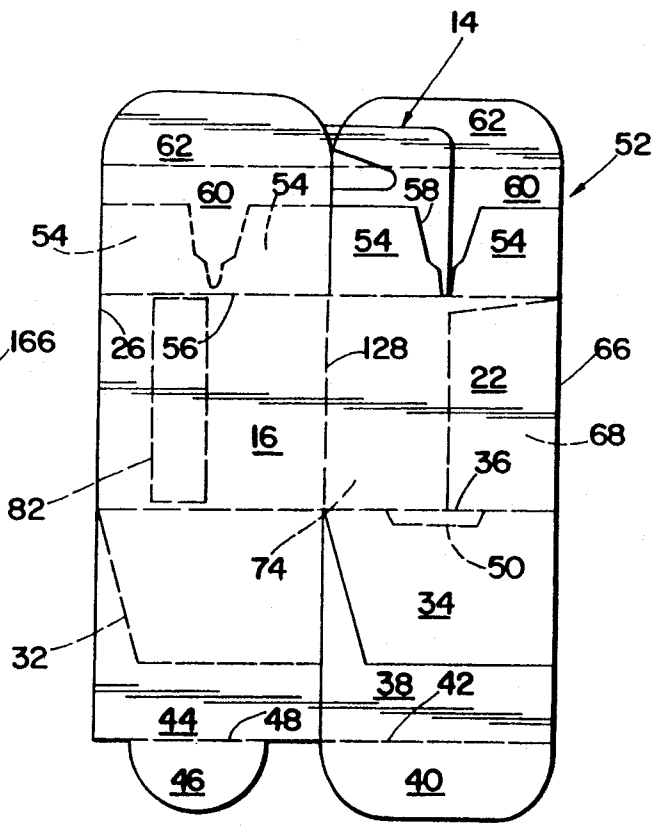
Figure 9:
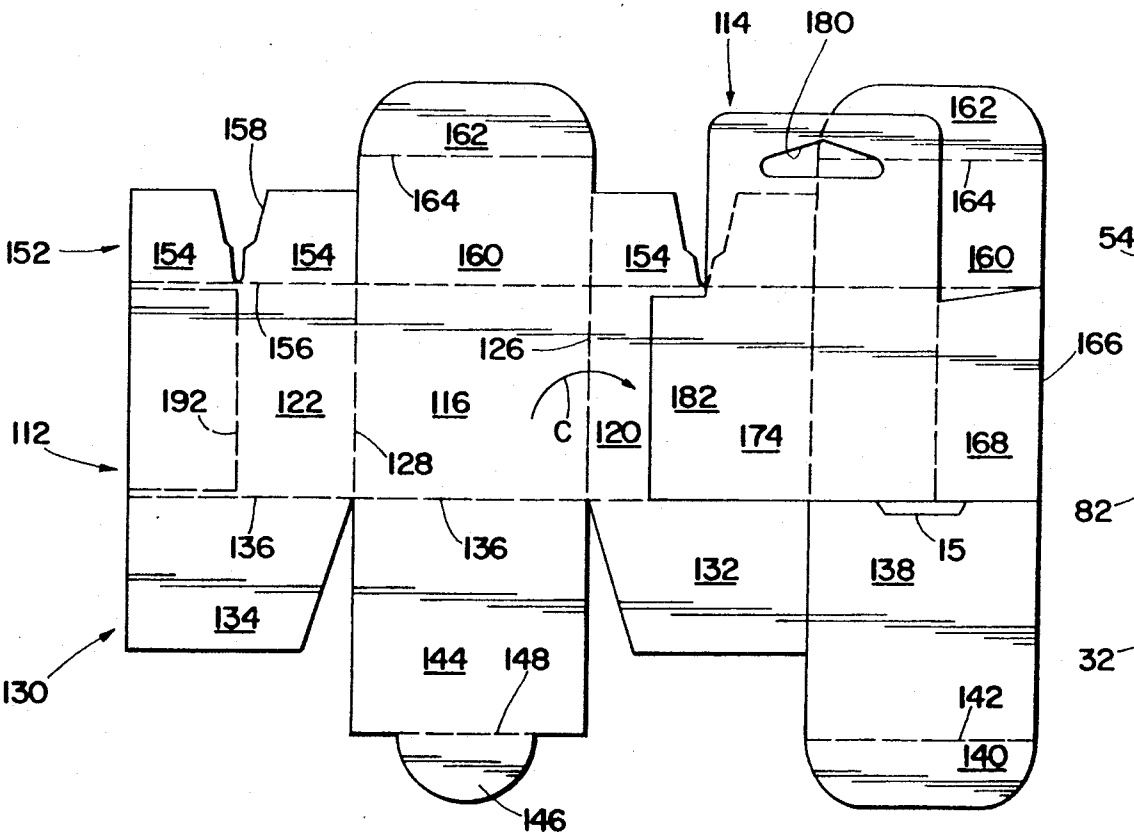

At this point, the originally flat production blank 110 has now been folded to form a flattened package 10. To expand flattened package 10 from its folded position as seen in FIG. 10, edge 66 and fold line 26 are compressed toward each other, causing front and rear panels 16 and 18 to extend from central divider 74 along fold lines 24, 28 with both panels remaining parallel to divider panel 74. With front and rear panels 16 and 18 and side panels 20 and 22 generally forming a rectangular cylinder 12 bottom fold-in flaps 32 and 34 may be folded into the interior of the rectangular cylinder 12 along hinge line 36. Fold-in flaps 32 and 34 are followed by tuck-in flap 38 with tab 40 folded along hinge line 42 so as to lie adjacent front panel 16. In a similar fashion, tuck-in flap 44 is folded along hinge line 36 over flap 40 with tab 46 inserted into perforation 50, locking tab 46 in the bottom of tuck-in flap 38. In the alternative, tabs 40 and 46 may not be cut in the blank and an adhesive may be applied either to flap 38 or 44 and folded accordingly, such that the adhesive bonds the two flaps together.

Top 52 of package 10 may be closed by folding fold-in flaps 54 into the container along hinge line 56. Cutout 58 of each fold-in flap 54 now accommodates divider panel 74 when folded into the container. Each chamber 15 on opposite sides of divider 74 may be closed by tuck-in flaps 60 overlying fold-in tabs 54. Tuck-in tabs 62 fold along hinge line 64 and lie adjacent divider panel 74 in the closed position and retain flaps 60 in place when closed.

The package as described above is well suited for carrying a plurality of cylindrical batteries. The unitary package minimizes the required amount of packaging material while maximizing the number of batteries that can be stored and displayed within a fixed volume. After the box has been opened, new batteries can be stored until they are needed and used cells can be inserted into the box after the new cells have been removed. Preferably, the blank and box is made from recycled paper that has been printed with water base ink on an exterior surface so the box can be recycled.

The Z-shaped tabs 68 and 82 coupling divider panel 74 to side panels 20 and 22 are important in that divider 74 is integral with the four vertical surfaces 16–22 of package 10. Since divider panel 74 is securely attached to side panels 20 and 22, there is no problem with distortion, breaking or tearing of the panels when the box is suspended by a hanger which extends through punch-out 80 at the top of divider panel 62. Divider panel 74 also virtually insures that package 10 will be generally square when it is expanded and will remain so when used by the consumer. Further, by centrally locating the divider, package 10 may be hung without tipping when on display.

Another key feature of package 10 is the incorporation of hinge 88 aligned with score line 56 at the top of the box. The ability to fold divider panel or header 74 flat against top 52 of package 10 provides for maximum density when packing the boxes for shipment or arranging them for display on a store's shelf. Extension of header or upper portion of divider panel 74 in a vertical direction allows package 10 to be hung in a conventional display rack while maximizing the box's surface area that is available for advertising.

Although not specifically addressed in the above description, it should be understood that each of the score lines between a flap or panel and a tab contain a slit along the outer margins. The purpose of each small slit is to lock the tab in the closed position by allowing the bases of the fold-in flaps to extend into each slit.

The invention has been described with respect to specific preferred embodiments thereof. However, many variations and modifications will become apparent to those skilled in the art. It is, therefore, the intention that the appended claims be interpreted as broadly as possible in view of the prior art to include all such variations and modifications.

I claim:

1. A box, comprising:

a plurality of panels defining a front panel and a back panel hingedly attached to side panels along parallel fold lines defining a top and a bottom opening;

bottom closure flaps dependent from a lower edge of said front, back and side panels, adapted to close the bottom opening thereof;

a divider panel dependent from one of said panels to an interior of said box and fixed to an opposite one of said panels, dividing the interior of said box into a first and a second interior volume and having an upper portion of said divider panel extending from said top opening for suspending said box from a display; and top closure flaps dependent from an upper edge of said front, back and side panels, adapted to close said top opening of said first and second interior volume defined by said divider panel, said upper portion of said divider panel extending from said top portion with said closure flaps closing said first and second interior volume.

2. A box as recited in claim 1, wherein said divider panel is hingedly coupled to an edge of one of said panels by a locater tab, said locater tab having an exterior surface bonded to another one of said panels.

3. A box as recited in claim 1, wherein said divider panel has at least one edge adhered to a centerline of at least one of said panels.

4. A box as recited in claim 1, wherein said bottom closure flaps include:

at least two opposing fold-in flaps each dependent from said lower edge of said side panels;

a first flap dependent from said lower edge of said front panel, and adapted to be folded over said fold-in flaps, and a second flap dependent from said lower edge of said back panel opposite said front panel and adapted to be folded over said first flap.

5. A box as recited in claim 4, further including means for retaining said first and second flaps in place, closing said bottom opening of said box.

6. A rectangular box as recited in claim 5, wherein said means for retaining said first and second flaps in place include tuck-in tabs.

7. A box as recited in claim 5, wherein said means for retaining said first and second flaps in place includes an adhesive between said first and second flaps.

8. A box as recited in claim 1, wherein said top closure flaps include:

a fold-in flap on each side of said divider panel and dependent from said upper edge of at least one of said panels, said fold-in flaps adapted to be folded into the first and second interior volumes defined by said divider panel; and a tuck-in flap on each side of said divider panel, and dependent from said upper edge of at least one of said panels, said tuck-in flaps adapted to be folded over and enclosing said fold-in flaps and said first and second interior volumes.

9. A box as recited in claim 1, wherein said divider panel includes:

a header panel hingedly attached to an upper edge of said divider panel and adhered thereagainst, said divider panel and header panel having a hole extending therethrough; and a hinge line defined in said divider panel substantially parallel to and coincident with said top of said box, whereby said divider panel may be folded down substantially parallel to said top opening of said box.

10. A box as recited in claim 1, wherein each of said panels, flaps and tabs are integrally interconnected by hinge or score lines.

11. A blank for a box having an integral divider, comprising:

a plurality of interconnected panels including a front panel, a rear panel, and a first side panel and a second side panel each having a top edge and a bottom edge;

upper and lower fold-in flaps defined along and integrally dependent from the top and bottom edge of said first and second side panel;

upper tuck-in flaps defined along and integrally dependent from the top edge of said front panel and said rear panel;

a divider panel integrally extending from one end of said plurality of panels, said divider panel having a bottom edge coterminous with the bottom edge of said panels, and an upper edge extending beyond the upper edge of said panels; and a header panel hingedly connected to an upper edge of said divider panel.

12. A blank as recited in claim 11, wherein said first side panel and said second side panel alternate with said front panel and said rear panel.

13. A blank as recited in claim 11, wherein said divider panel includes:

a locater tab extending therefrom and integrally dependent from said rear panel; and a glue tab extending from an edge of said divider panel opposite said locater tab.

14. A blank as recited in claim 11, wherein said upper fold-in flaps contain a cutout.

15. A box, comprising:

a body having four sidewalls, a bottom sealed by a first set of flaps and a top sealed by a second set of flaps;

a divider panel centrally located within said body, interconnecting opposing ones of said sidewalls and extending from the top of said body between said second set of flaps sealing said top.

16. The box as recited in claim 15, wherein said divider panel extends from and is integrally interconnected to an edge of one of said sidewalls.

17. The box as recited in claim 16, further comprising:

a locater tab integral with an interconnecting one of said sidewalls and said divider panel; and a glue tab integral with said divider panel and extending from an edge opposite said locater tab, said glue tab and locater tab adhered to opposing ones of said sidewalls.

18. The box as recited in claim 17, wherein each of said sidewalls, first and second sets of flaps and divider panel are integrally interconnected by at least one of a scoreline and a hinge line.

19. The box as recited in claim 18, wherein said divider panel further comprises a header panel integrally interconnected to an edge of said divider panel.

20. The box as recited in claim 15, wherein said divider panel includes a hinge line parallel and generally coincident with the top of said box to enable said divider panel to fold over substantially flat along the top of said box.

21. The box as recited in claim 15, wherein said divider panel defines at least two chambers within an interior of said body.

22. The box as recited in claim 21, wherein said at least two chambers are substantially equal in size.

23. A box, comprising:

a plurality of panels defining a front panel and a back panel hingedly attached to side panels along parallel fold lines defining a top and a bottom opening;

bottom closure flaps dependent from a lower edge of said front, back and side panels, adapted to close the bottom opening thereof;

a divider panel dependent from one of said panels to an interior of said box and fixed to an opposite one of said panels, dividing the interior of said box into a first and a second interior volume and having an upper portion of said divider panel extending from said top opening;

top closure flaps dependent from an upper edge of said front, back and side panels, adapted to close said top opening of said first and second interior volume defined by said divider panel, said upper portion of said divider panel extending from said top portion with said closure flaps closing said first and second interior volume, said divider panel having a header panel hingedly attached to an upper edge of said divider panel and adhered thereagainst, said divider panel and header panel having a hole extending therethrough; and a hinge line defined in said divider panel substantially parallel to and coincident with said top of said box, whereby said divider panel may be folded down substantially parallel to said top opening of said box.

24. A blank for a box having an integral divider, comprising:

a plurality of interconnected panels including a front panel, a rear panel, and a first side panel and a second side panel each having a top edge and a bottom edge;

upper and lower fold-in flaps defined along and integrally dependent from the top and bottom edge of said first and second side panel;

upper tuck-in flaps defined along and integrally dependent from the top edge of said front panel and said rear panel;

a divider panel integrally extending from one end of said plurality of panels, said divider panel having a bottom edge coterminous with the bottom edge of said panels, and an upper edge extending beyond the upper edge of said panels;

a header panel hingedly connected to an upper edge of said divider panel;

a locater tab extending therefrom and integrally dependent from said rear panel; and a glue tab extending from an edge of said divider panel opposite said locater tab.

25. A box, comprising:

a body having four sidewalls, a bottom sealed by a first set of flaps and a top sealed by a second set of flaps;

a divider panel centrally located within said body, interconnecting opposing ones of said sidewalls and extending from the top of said body between said second set of flaps sealing said top, said divider panel extends from and is integrally interconnected to an edge of one of said side panels;

a locater tab integral with and interconnecting one of said sidewalls and said divider panel; and a glue tab integral with said divider panel and extending from an edge opposite said locater tab, said glue tab and locater tab adhered to opposing ones of said sidewalls.

26. A box, comprising:

a body having four sidewalls, a bottom sealed by a first set of flaps and a top sealed by a second set of flaps;

a divider panel centrally located within said body, interconnecting opposing ones of said sidewalls and extending from the top of said body between said second set of flaps sealing said top, said divider panel extends from and is integrally interconnected to an edge of one of said side panels;

a locater tab integral with and interconnecting one of said sidewalls and said divider panel; and a glue tab integral with said divider panel and extending from an edge opposite said locater tab, said glue tab and locater tab adhered to opposing ones of said sidewalls, wherein each of said side panels, first and second sets of flaps and divider panel are integrally interconnected by at least one score line and hinge line.

* * * * *